US011497281B2

(12) United States Patent
de Castro

(10) Patent No.: US 11,497,281 B2
(45) Date of Patent: Nov. 15, 2022

(54) SECURING SYSTEM FOR FOOTWEAR

(71) Applicant: TERRAIGNOTA Ventures, LLC, Newton Center, MA (US)

(72) Inventor: José Tadeo V. de Castro, Newton, MA (US)

(73) Assignee: Terraignota Ventures, LLC, Newton, MA (US)

( * ) Notice: Subject to any disclaimer, the term of this patent is extended or adjusted under 35 U.S.C. 154(b) by 368 days.

(21) Appl. No.: 16/773,129

(22) Filed: Jan. 27, 2020

(65) Prior Publication Data

US 2020/0237057 A1 Jul. 30, 2020

Related U.S. Application Data

(60) Provisional application No. 62/797,510, filed on Jan. 28, 2019.

(51) Int. Cl.
*A44B 18/00* (2006.01)

(52) U.S. Cl.
CPC ..... *A44B 18/008* (2013.01)

(58) Field of Classification Search
CPC ..... A44B 18/008; A43B 5/025; A43B 5/18; A43B 19/00; A43C 11/1493; A43C 11/22; A43C 11/24; A43C 19/00
See application file for complete search history.

(56) References Cited

U.S. PATENT DOCUMENTS

| | | | | | |
|---|---|---|---|---|---|
| 1,643,108 | A * | 9/1927 | Bendelari | A43C 11/00 | 36/50.1 |
| 3,800,446 | A | 4/1974 | Pass | | |
| 4,486,965 | A * | 12/1984 | Friton | A43C 11/1493 | D2/978 |
| 4,669,202 | A | 6/1987 | Ottier | | |
| D342,824 | S * | 1/1994 | Bevier | D2/973 | |
| 5,307,569 | A * | 5/1994 | Melcher | A43D 999/00 | 36/50.1 |
| D348,766 | S * | 7/1994 | Bevier | D2/970 | |
| 6,745,500 | B2 * | 6/2004 | Suzuki | A43B 11/00 | 36/50.1 |
| 6,857,204 | B1 * | 2/2005 | Davis | A43B 3/12 | 24/442 |
| 9,700,097 | B2 * | 7/2017 | McCleary | A43B 3/126 | |
| 9,700,102 | B2 * | 7/2017 | McCleary | A43C 1/04 | |
| 11,129,450 | B1 * | 9/2021 | Mancini | A44B 11/258 | |
| 2009/0007457 | A1 | 1/2009 | Skirrow | | |
| 2018/0192745 | A1 * | 7/2018 | McDaniel | A43B 3/0047 | |

FOREIGN PATENT DOCUMENTS

| | | | |
|---|---|---|---|
| EP | 2319341 | A1 | 5/2011 |
| FR | 2293884 | A1 | 7/1976 |
| KP | 20030033797 | A | 5/2003 |
| WO | 2015117179 | A1 | 8/2015 |

* cited by examiner

*Primary Examiner* — Robert Sandy
*Assistant Examiner* — Louis A Mercado
(74) *Attorney, Agent, or Firm* — Occhiutti & Rohlicek LLP

(57) ABSTRACT

A cap for capping an upper surface of a shoe a first layer, a second layer, and a third layer. The first layer has an outer surface that has a coefficient of friction that is greater than that of the upper surface of the shoe that the cap caps. The second layer is an adhesive layer. The third layer is a release layer that can be peeled off the adhesive layer to expose it, thereby enabling the adhesive layer to stick to the shoe.

11 Claims, 4 Drawing Sheets

SECURING SYSTEM FOR FOOTWEAR

RELATED APPLICATIONS

This application claims the benefit of the Jan. 28, 2019 priority date of U.S. Provisional Application 62/797,510, the contents of which are incorporated herein by reference.

FIELD OF DISCLOSURE

This disclosure relates to footwear, and in particular, to accessories to enhance the function of footwear.

BACKGROUND

Athletic shoes typically have laces that, when tightened, cause the shoe to more securely engage the foot. In certain athletic contests, players use the foot to exert force on a ball. The contact area between the ball and the shoe is therefore critical to controlling this force.

The laces occupy a considerable amount of shoe area. In addition, the laces present an irregular contact surface having a topology that changes each time the shoe is tied. As a result, when the player contacts the ball with the laces, the result can be unpredictable.

SUMMARY

In one aspect, the invention features a cap for adhering to an upper surface of a shoe. Such a cap includes first and second sets of fingers and a midline. The first and second sets of fingers projects towards the midline and towards each other so that they are inter-digitated. Each finger has an adhesive side that is covered by a release layer. The release layer can be peeled off to expose adhesive. This permits the fingers to adhere to the upper surface of the shoe.

In some embodiments, the cap features first and second lobes with the first set of fingers projecting from the first lobe and the second set of fingers projecting from the second lode.

In other embodiments, one or more fingers comprises a fiber that extends along the finger. The fiber serves to reinforce the finger and can be molded to or attached to the finger.

In some embodiments, the cap comprises a first layer, a second layer, and a third layer. The first layer has an outer surface that has a coefficient of friction that is greater than the upper surface of a shoe to be capped by the cap. The second layer is an adhesive layer. The third layer is a release layer that can be peeled off the adhesive layer to expose the adhesive layer, thereby enabling the adhesive layer to stick to the shoe.

Also among the amendments are those that include a second set of layers that are disposed on the first layer. This second set of layers comprising a gripping layer and an adhesive layer, with the adhesive layer being between the first layer and the gripping layer.

Also among the embodiments are those in which the first layer includes neoprene, those in which the first layer includes a thermoplastic urethane, those in which the first layer includes a thermoplastic elastomer, and those in which the first layer includes silicone.

Other embodiments include those in which the third layer is segmented so that different portions of the second layer are exposable independently of each other. This eases the task of installing the cap on the shoe.

Further embodiments include those in which the fingers extend along lines perpendicular to the midline and those in which the fingers extend along lines that are oblique to the midline.

In another aspect, the invention features manufacturing a cap for covering an upper surface of a shoe by forming fingers that project towards a midline of the cap and that extend towards each other, the fingers being inter-digitated when extended and causing each of the fingers to have an adhesive side covered by a release layer that can be peeled off to expose adhesive, thereby permitting the fingers to adhere to the upper surface of the shoe.

These and other features of the invention will be apparent from the following detailed description and the accompanying figures, in which:

DETAILED DESCRIPTION

Figure 1:
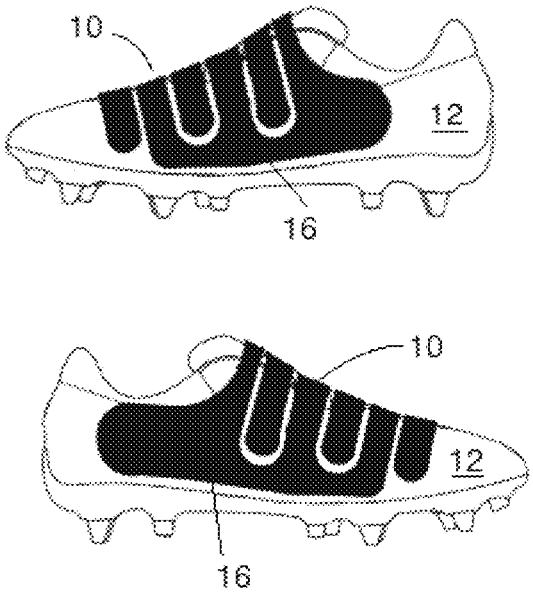
FIG. 1 shows two views of a shoe having a cap adhesively bonded thereon.
Figure 3:
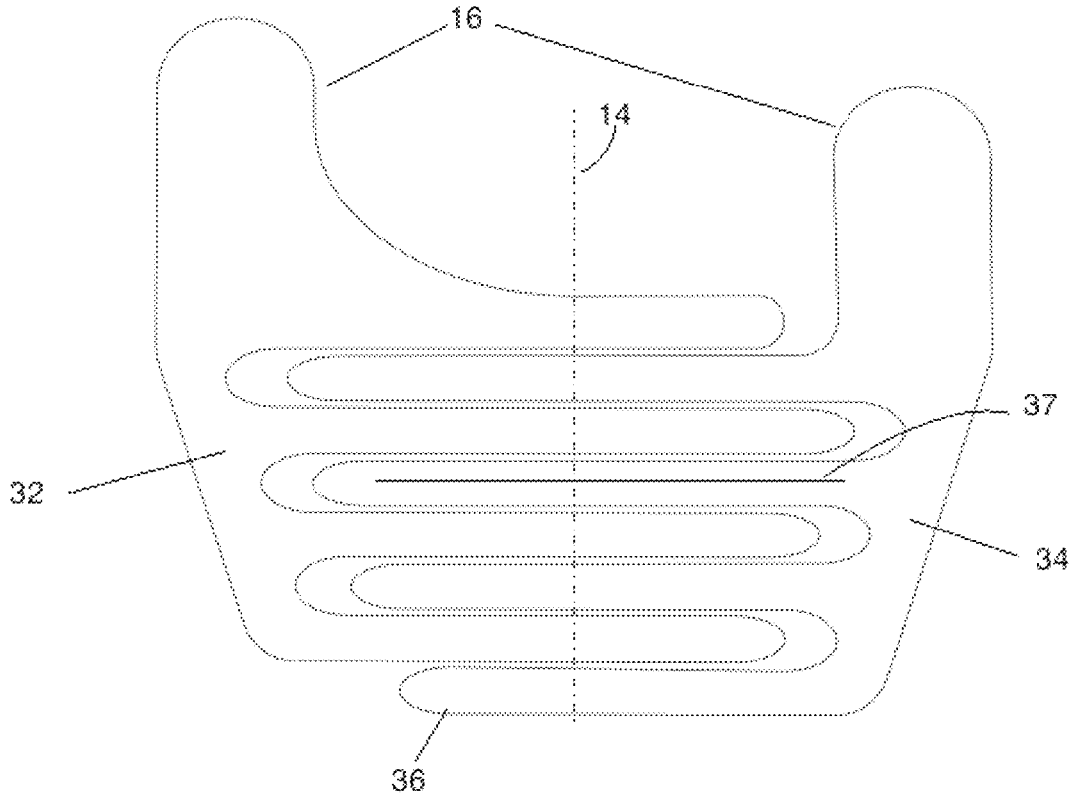
FIG. 3 shows a plan view of the cap of FIG. 1.
Figure 4:
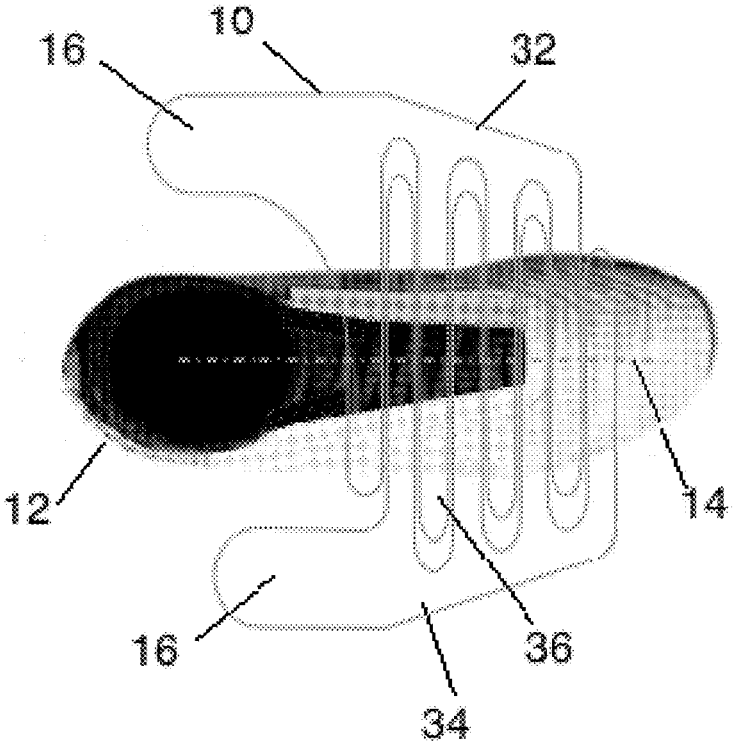
FIG. 4 shows the cap of FIG. 3 prior to placement on the shoe shown in FIG. 1.

FIG. 1 shows a cap 10 that has been attached to a shoe 12 and that covers the shoe's upper. The cap 10 has a midline 14, which is best seen in FIGS. 3 and 4. In some embodiments, the shoe 12 is one that does not have laces or one from which the laces have been removed. A suitable type of shoe 12 is a soccer shoe or a football shoe.

Extending laterally from the midline 14 on either side are lobes 16 that extend far enough so that, when folded over as shown in FIG. 1, the lobes 16 cover the shoe's vamp 18 and its side 20. In some embodiments, the lobes are rounded to suppress a tendency to peel off. In other embodiments, the lobes have sharp corners.

As is apparent from FIGS. 3 and 4, the cap 10 has essentially bilateral symmetry, with minor variations to accommodate the shape of the shoe 12.

Figure 2:
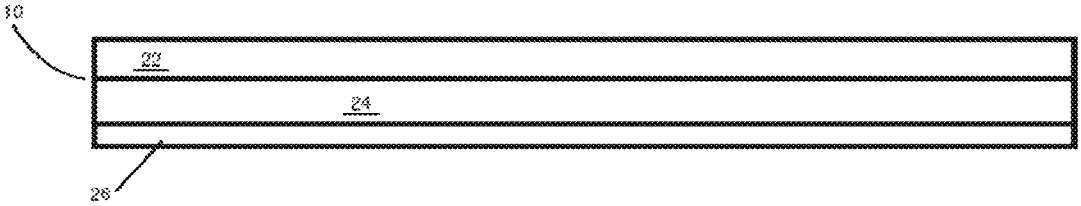
FIG. 2 shows a cross-section of the lasting cap shown in FIG. 1.

The cap 10 is a multilayer structure having flexible first, second, and third layers 22, 24, 26, as shown in FIG. 2.

The first layer 22 is a gripping layer having an outer surface and an inner surface. The outer surface is made of a material having a first friction coefficient. The shoe itself has a second friction coefficient. The first friction coefficient exceeds the second friction coefficient. The inner surface faces the second layer 24. Suitable materials for use as a first layer 22 include neoprene, silicone, and mixtures thereof, including high-gloss silicone. Other suitable materials include thermoplastic urethane and thermoplastic elastomer.

In some embodiments, the first layer 22 has a thickness of about 0.038 inches. In other embodiments, the first layer 22 has a thickness in the range between $N*10^{-2}$ inches and $(N+1)*10^{2}$ inches where N is an integer between 1 and 5 inclusive.

In some embodiments, the coefficient of friction of the first layer 22 is 2.0 when dry and 1.4 when wet. In other embodiments, the coefficient of friction of the first layer 22 is 1.3 when dry and 1.1 when wet. Yet other embodiments include those in which the coefficient of friction, whether wet or dry, is between N and N+1 where N is an integer between 1 and 3 inclusive.

Yet other embodiments include those in which the hardness of the first layer 22, as measured by a Shore A durometer, is between 13 and 73. In still other embodiments, the hardness of the first layer 22 as measured by a Shore A durometer is in one of the ranges defined by a value between N*10 and (N+1)*10 where N is an integer between 1 and 7 inclusive.

The second layer 24 is an adhesive layer having an outer surface and an inner surface. The outer surface of the second layer 24 adheres to the inner surface of the first layer 22. The inner surface of the second layer 24 adheres to the third layer 26. This third layer 26 is a release layer that is peeled off to expose the adhesive on the second layer 24 so that the cap 10 can be attached to the shoe 12.

FIG. 3 shows a view of the cap 10 from which it is possible to see first and second finger-sets 32, 34 having fingers 36 that project in opposite directions from each lobe 16 towards, and ultimately past, the midline 14. The first and second finger-sets 32, 34 are offset along a longitudinal axis of the shoe by a distance sufficient to allow the first and second finger-sets 32, 34 to be inter-digitated.

In some embodiments, the one or more fingers 36 comprise one or more directional fibers 37 to provide reinforcement. The directional fibers 37 preferably contact the first layer 22. Such contact can be achieved in a variety of ways, including by molding the fibers 37 into the first layer 22 or by bonding the fibers 37 with the first layer 22.

Prior to being placed on the shoe 12, the player lays out the cap 10 so that it is flat, as shown in FIG. 4. The player then peels off the third layer 26, thus exposing the adhesive second layer 24. The player then places the cap 10 over the shoe as shown in FIG. 4 and folds the lobes 16 into position as shown in FIG. 1.

After having secured the lobes 16, the player then tugs on a pair of opposed fingers 36 from the first and second finger sets 32, 34 to tighten the fit of the shoe 12. When the shoe 12 is sufficiently tight, the player presses down on the fingers 36, thus causing them to adhere to the shoe 12. The player then moves to the next pair of opposed fingers 36 and repeats this procedure until all pairs of fingers 36 have been made to adhere to the shoe. In this configuration, the fingers 36 cooperate to carry out the function of laces, but without the ridges and valleys that inevitably arise using laces.

At this point, the shoe 12 will have been secured to the player's foot. Additionally, the upper surface of the shoe 12, where laces would normally have been present, now presents a smooth surface that will interact with the ball in a more predictable manner.

Figure 5:
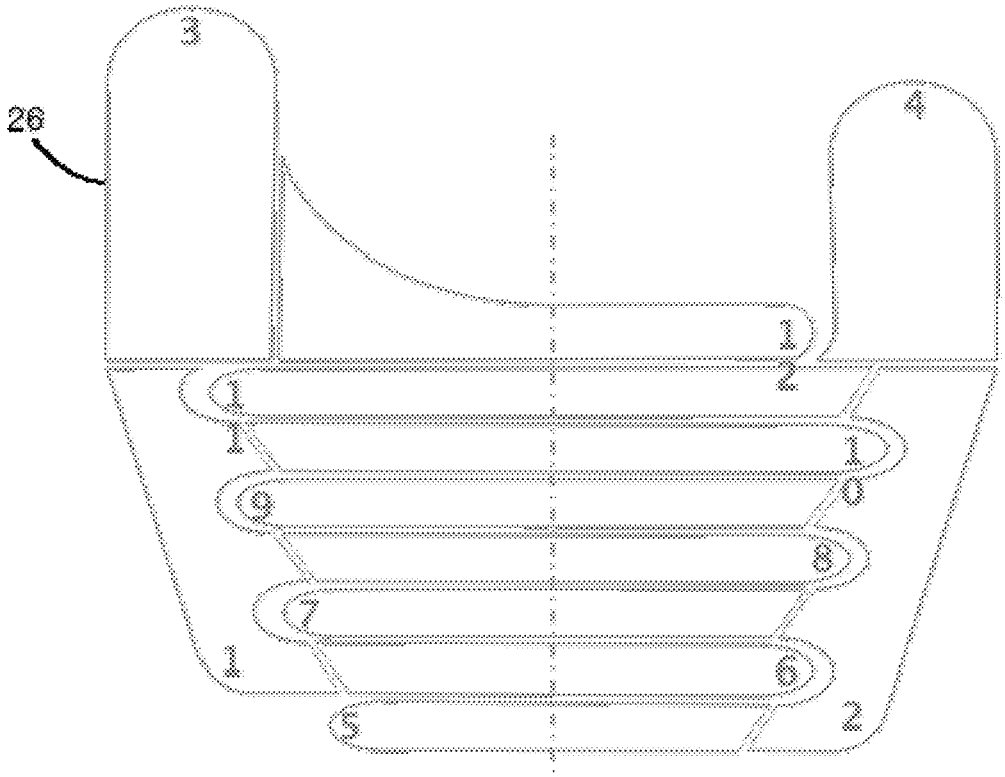
FIG. 5 shows a pattern of release layers for the cap shown in FIG. 3.
Figure 6:
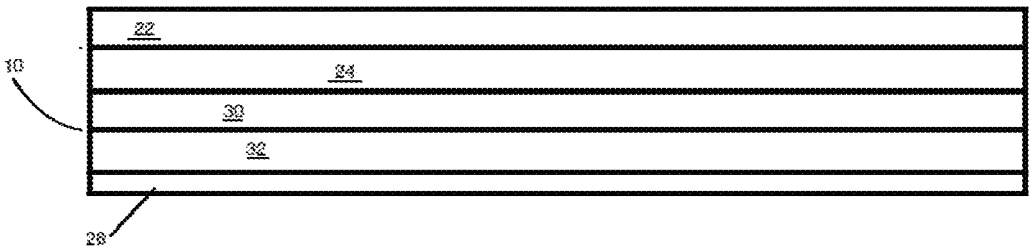
FIG. 6 shows a cross-section of an alternative embodiment of the cap shown in FIG. 1.

In some cases, each finger 36 has its own separate third layer 36 that can be removed independently. This makes attaching the fingers 36 to the shoe 12 much easier. FIG. 5 shows an embodiment in having a segmented third layer 26 for exposing different portions of the second layer 24 independently of other portions. Using this embodiment, it is possible to place different sections of the cap 10 onto the shoe 12 without worrying that an exposed adhesive surface will prematurely make contact with the shoe 12 and ruin the application. This makes the experience of putting the cap 10 on the shoe 12 much easier.

Once the cap 10 has been correctly positioned, the player proceeds to enjoy the higher coefficient of friction associated with the first layer 22 together with the smooth upper surface provided by having used the fingers 36 instead of laces to secure the shoe 12.

As time goes on, the player will soon discover that a decline in ball-handling ability as a result of wear on the first layer 22. When this happens, the player has the option of replacing the cap 10 with a fresh cap.

An alternative embodiment, shown in FIG. 5 features a first first-layer 22, the first set of layers is in series with a second set of layers. In particular, the cap 10 shown in FIG. 5 has a first second-layer 24 in series with a second first-layer 30 and a second second-layer 32. In this embodiment, the player relies on the first first-layer 22 until it has become worn. At this point, the player simply peels off the first first-layer 22 and the first second-layer 24 so as to expose the second first layer 30. This series connection of layers can continue, with the constraint being that as the number of layers increases, the cap 10 becomes unwieldy.

In some embodiments, the friction layer 22 includes various surface features or textures. These include raised features, such as bosses, ridges, and bumps. These also include concave or depressed features, such as grooves, sipes or dimples. In some embodiments, the first layer includes perforations, apertures, or through-holes. In yet other embodiments, the first layer 22 includes dimples having a depth equal to the thickness of the first layer.

Having described the invention and a preferred embodiment thereof, what we claim as new and secured by Letters Patent is:

1. A manufacture comprising a cap for adhering to an upper surface of a shoe, wherein said cap comprises a first set of fingers, a second set of fingers, and a midline, wherein said first set of fingers projects towards said midline, wherein said second set of fingers projects towards said midline, wherein said first and second sets of fingers extend towards each other, wherein said first and second sets of fingers are inter-digitated, and wherein said fingers each have an adhesive side covered by a release layer that can be peeled off to expose adhesive, thereby permitting said fingers to adhere to said upper surface of said shoe, wherein said fingers comprise a first finger, wherein said first finger extends along a direction, and wherein said first finger comprises a fiber that extends along said direction.

2. The manufacture of claim 1, wherein said cap comprises first and second lobes, wherein said first set of fingers projects from said first lobe and wherein said second set of fingers projects from said second lobe.

3. The manufacture of claim 1, wherein an upper surface of said shoe has a first coefficient of friction, wherein said cap comprises a first set of layers, wherein said first set of layers comprises a first layer, a second layer, and a third layer, wherein said first layer has an outer surface that has a second coefficient of friction, wherein said second coefficient of friction exceeds said first coefficient of friction, wherein said second layer is an adhesive layer, and wherein said third layer is a release layer that can be peeled off said adhesive layer to expose said adhesive layer, thereby enabling said adhesive layer to stick to said shoe.

4. The manufacture of claim 3, wherein said first layer comprises silicone.

5. The manufacture of claim 3, wherein said first layer comprises thermoplastic urethane.

6. The manufacture of claim 3, wherein said first layer comprises thermoplastic elastomer.

7. The manufacture of claim 3, wherein said first layer comprises neoprene.

8. The manufacture of claim 1, wherein said fingers extend along lines that are perpendicular to said midline.

9. The manufacture of claim 1, wherein said fingers extend along lines that are oblique to said midline.

10. A manufacture comprising a cap for adhering to an upper surface of a shoe, wherein said cap comprises a first set of fingers, a second set of fingers, and a midline, wherein said first set of fingers projects towards said midline, wherein said second set of fingers projects towards said midline, wherein said first and second sets of fingers extend towards each other, wherein said first and second sets of fingers are inter-digitated, and wherein said fingers each have an adhesive side covered by a release layer that can be peeled off to expose adhesive, thereby permitting said fingers to adhere to said upper surface of said shoe, wherein an upper surface of said shoe has a first coefficient of friction, wherein said cap comprises a first set of layers, wherein said first set of layers comprises a first layer, a second layer, and a third layer, wherein said first layer has an outer surface that has a second coefficient of friction, wherein said second coefficient of friction exceeds said first coefficient of friction, wherein said second layer is an adhesive layer, and wherein said third layer is a release layer that can be peeled off said adhesive layer to expose said adhesive layer, thereby enabling said adhesive layer to stick to said shoe, said manufacture being selected from the group consisting of a manufacture that further comprises a second set of layers, said second set of layers comprising a gripping layer and an adhesive layer, said adhesive layer being between said first layer and said gripping layer and a manufacture in which said third layer is segmented such that different portions of said second layer are exposable independently of each other.

11. A method comprising manufacturing a cap for covering an upper surface of a shoe, said method comprising forming fingers that project towards a midline of said cap and that extend towards each other, said fingers being inter-digitated when extended and causing each of said fingers to have an adhesive side covered by a release layer that can be peeled off to expose adhesive, thereby permitting said fingers to adhere to said upper surface of said shoe, wherein forming said fingers comprises forming a first finger that extends along a direction, said first finger comprising a fiber that extends along said direction.

* * * * *